US005839479A

United States Patent [19]

Gulya et al.

[11] Patent Number: 5,839,479

[45] Date of Patent: Nov. 24, 1998

[54] PAPERMAKING FABRIC FOR INCREASING BULK IN THE PAPER SHEET

[75] Inventors: Thomas Gulya, Raleigh, N.C.; Samuel H. Herring, Appleton; Walter P. Wright, Larsen, both of Wis.

[73] Assignee: Asten, Inc., Charleston, S.C.

[21] Appl. No.: 832,314

[22] Filed: Mar. 26, 1997

Related U.S. Application Data

[63] Continuation of Ser. No. 627,409, Apr. 4, 1996, abandoned.

[51] Int. Cl.[6] ..... D03D 13/00

[52] U.S. Cl. ..... 139/383 A; 162/116; 162/902; 162/903; 442/203

[58] Field of Search ..... 162/116, 117, 162/902, 903; 442/20; 139/383 A

[56] References Cited

U.S. PATENT DOCUMENTS

| | | | |
|---|---|---|---|
| 3,301,746 | 1/1967 | Sanford et al. | 162/113 |
| 3,573,164 | 3/1971 | Friedberg et al. | 162/348 |
| 3,905,863 | 9/1975 | Ayers | 162/113 |
| 4,182,381 | 1/1980 | Gisbourne | 139/383 A |
| 4,191,609 | 3/1980 | Trokhan | 162/113 |
| 4,239,065 | 12/1980 | Trokhan | 139/383 A |
| 4,281,688 | 8/1981 | Kelly et al. | 139/383 A |
| 4,423,755 | 1/1984 | Thompson | 139/383 A |
| 4,909,284 | 3/1990 | Kositzke | 139/383 A |
| 4,989,648 | 2/1991 | Tate et al. | 139/383 A |
| 4,995,428 | 2/1991 | Tate et al. | 139/383 A |
| 4,998,569 | 3/1991 | Tate | 139/383 A |
| 5,013,330 | 5/1991 | Durkin et al. | 139/383 A |
| 5,151,316 | 9/1992 | Durkin et al. | 428/213 |
| 5,158,118 | 10/1992 | Tate et al. | 139/383 A |
| 5,211,815 | 5/1993 | Ramasubramanian et al. | 139/383 A |
| 5,368,696 | 11/1994 | Cunnane, III et al. | 162/358.2 |
| 5,456,293 | 10/1995 | Ostermayer et al. | 139/383 A |
| 5,542,455 | 8/1996 | Ostermayer et al. | 139/383 A |

FOREIGN PATENT DOCUMENTS

| | | |
|---|---|---|
| 2192907 | 1/1988 | United Kingdom . |
| 2292755 | 3/1996 | United Kingdom . |

*Primary Examiner*—Andy Falik
*Attorney, Agent, or Firm*—Volpe & Koenig, PC

[57] ABSTRACT

A papermaking fabric for increasing bulk in the paper sheet during forming and/or through air drying which is comprised of a system of MD filaments selectively interwoven with a system of CD filaments having at least smaller and larger filament subsets.

12 Claims, 4 Drawing Sheets

PAPERMAKING FABRIC FOR INCREASING BULK IN THE PAPER SHEET

This application is a continuation of application Ser. No. 08/627,409, filed on Apr. 4, 1996 now abandoned.

BACKGROUND OF THE INVENTION

1. Field of the Invention

This invention relates generally to papermaking fabrics. It relates more specifically to forming and through air drying fabrics. It relates most especially to fabrics for increasing bulk in the paper sheet during the paper forming and/or through air drying processes.

2. Description of Related Art

In the papermaking process, papermaking machines transform an aqueous slurry of fibers into a continuous paper web which can be processed for a variety of end uses. Papermaking fabrics are employed throughout the papermaking process to transport the web of paper as a continuous sheet through the papermaking equipment. The papermakers fabrics also act as a drive belt for the equipment.

The papermaking process starts in the forming section of a papermaking machine where the aqueous slurry is deposited onto a forming fabric. The forming fabric desirably retains the paper fibers while allowing excess water to pass through. The wet paper web created by this process is then carried by a press fabric through the press section where additional water is removed by squeezing the paper web and fabric between two rolls. The paper web is then carried through the drying section on a dryer fabric to remove additional water through forced evaporation. The design of papermakers fabrics used on each section of a papermaking machine vary in accordance with function.

In the forming section of papermaking machines, the fibers are retained and collected on the upper surface of a forming fabric and formed into a paper sheet. The forming fabric must have a fine mesh weave on the paper contact side in order to avoid marking the paper and to support the fiber from the slurry. The fabric must also have good drainage characteristics for initial water removal to facilitate paper formation. However, as previously noted, the forming fabric also serves as a drive belt and is subjected to high tensile loads in the machine direction and compressive or buckling loads in the cross machine direction.

The performance of a fourdrinier papermaking machine improves when the sheet forms high on the sheet bearing surface of the forming fabric. Where the sheet forms high on the surface of the forming fabric, the sheet releases better, not being trapped within the web, and thus allows for higher machine speeds and higher paper machine efficiency. Additionally when the sheet forms high on the fabric, paper surface wire marking is reduced. Conversely, for applications like tissue and toweling, it may be desirable to form a web with some fibers in the "Z" directions to create additional bulk in the paper sheet before finishing processes such as through air drying.

After forming, the paper web may be subjected to a through air drying step to impart additional bulk and absorbency thereto. Accordingly, it is desirable to have a papermaking fabric which provides high fabric sheet forming along with increasing bulk and absorbency of the resultant paper product. It is also desirable to have such a papermaking fabric with improved wear capabilities.

SUMMARY OF THE INVENTION

A papermaking fabric which imparts bulk to a paper product and has a sheet side and a machine side is comprised of a system of MD filaments selectively interwoven with a system of CD filaments having at least smaller and larger filament subsets, the MD filaments and the larger CD filaments define maximum floats on opposite sides of the fabric that differ by no more than one filament and the smaller CD filaments define floats or knuckles on opposite sides of the fabric that are within two filaments of each other and define sheet side areas of paper bulking depressions.

It is an object of the present invention to provide a papermaking fabric, particularly a forming or through air drying fabric, having both improved sheet support and wear characteristics while giving bulk to the sheet.

DETAILED DESCRIPTION OF THE PREFERRED EMBODIMENT

The invention will be described with reference to drawing figures wherein like numerals represent like elements throughout.

Figure 1:
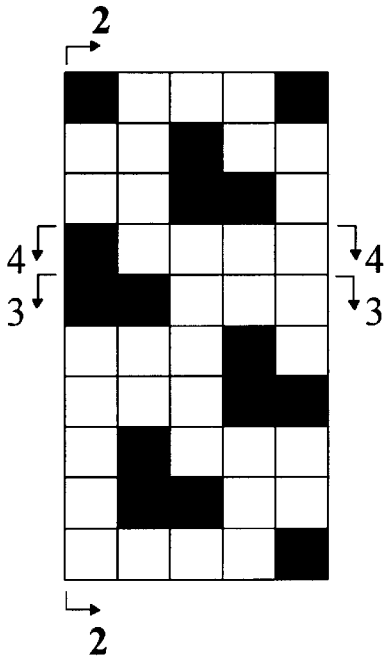
FIG. 1 is a weave pattern diagram of a papermaking fabric according to the present invention.
Figure 2:
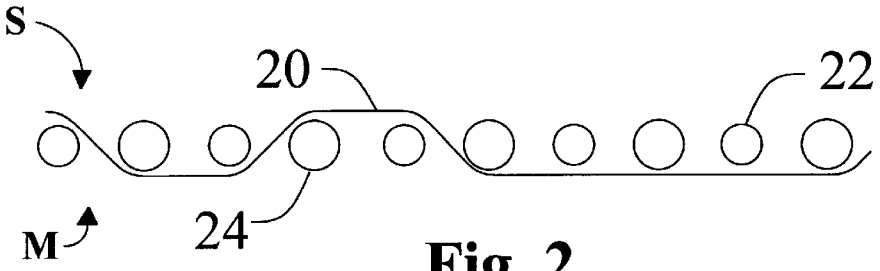
FIG. 2 is a sectional view along line 2—2 in FIG. 1 depicting the weave pattern of a first MD filament interweaving with the CD filaments of the fabric.
Figure 3:
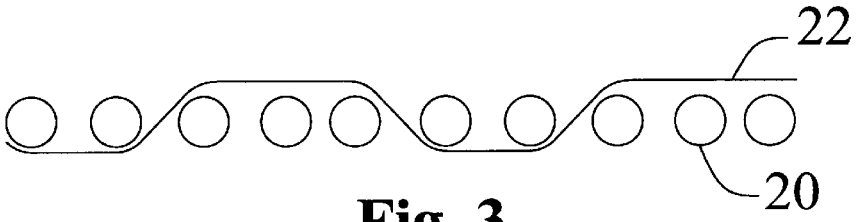
FIG. 3 is a sectional view along line 3—3 in FIG. 1 depicting the weave pattern of a smaller diameter CD filament interweaving with the MD filaments of the fabric.
Figure 4:
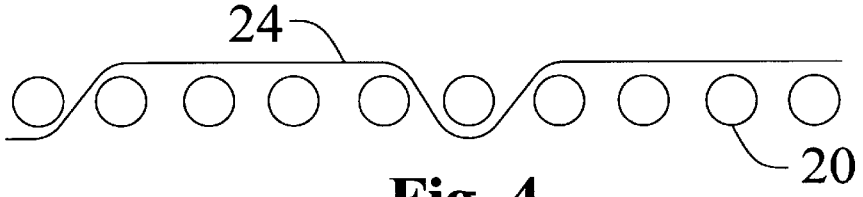
FIG. 4 is a sectional view along line 4—4 in FIG. 1 depicting the weave pattern of a larger diameter CD filament interweaving with the MD filaments of the fabric.

Referring to FIGS. 1–4, fabric 1 has a system of machine direction filaments (MD) 20 interwoven with a system of alternating smaller and larger diameter cross direction filaments 22, 24. The fabric has the sheet side S and a machine side M. As shown in FIG. 2, MD filaments 20 weave in a repeat pattern of over one, under two, over two, and under five with respect to both the smaller and larger diameter CD filaments 22, 24. As shown in FIG. 3, the smaller diameter CD filaments 22 weave in a repeat pattern of under two and over three with respect to MD filaments 20. As shown in FIG. 4, the larger diameter CD filaments 24 weave in a repeat pattern of under one and over four with respect to MD filaments 20. The long sheet side floats of the larger diameter CD filaments 24 weave opposite the long machine side floats of the smaller diameter CD filaments 22.

Figure 1A:
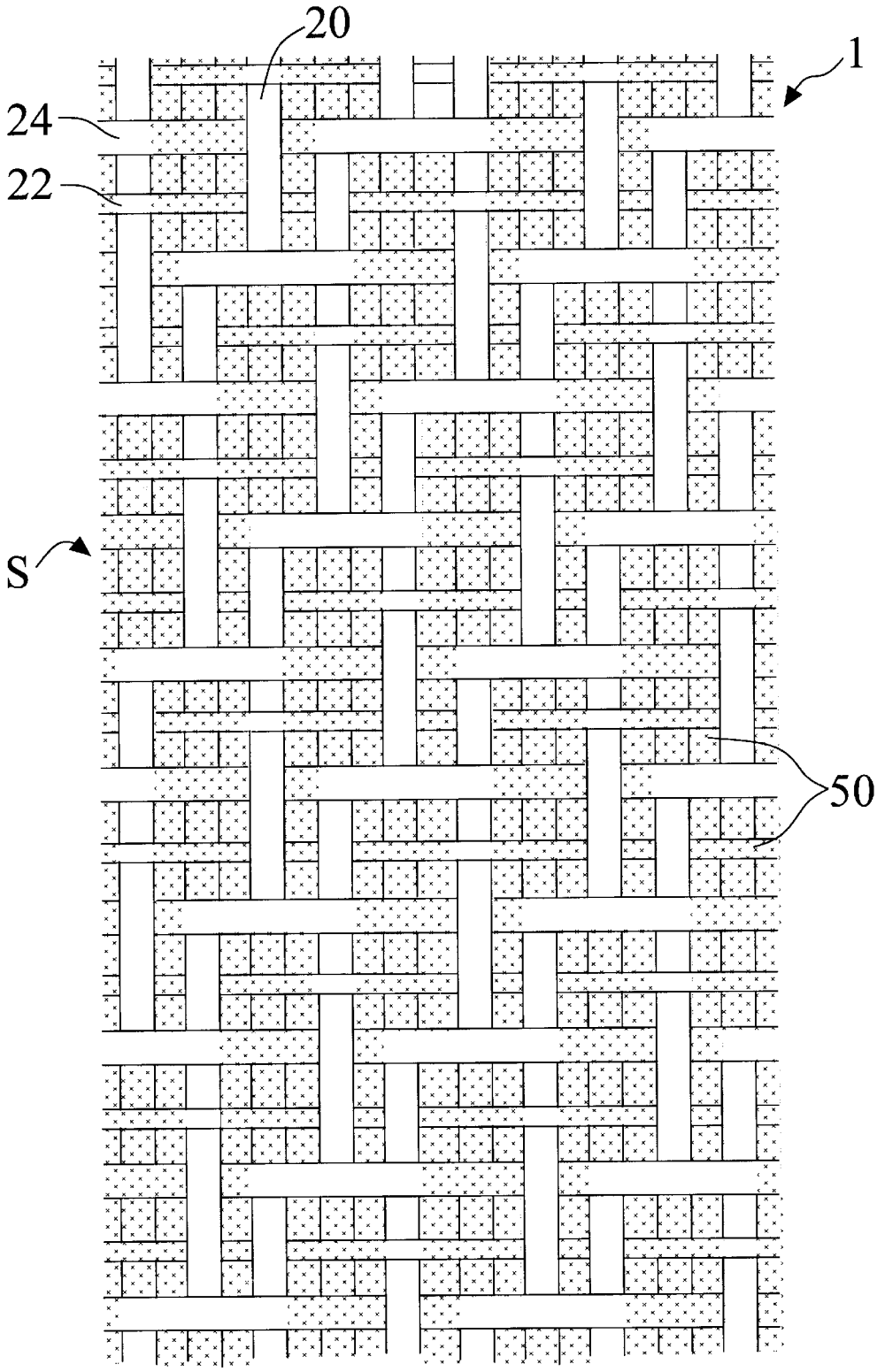
FIG. 1*a* is a top plan view of a papermaking fabric according to the present invention.
Figure 5:
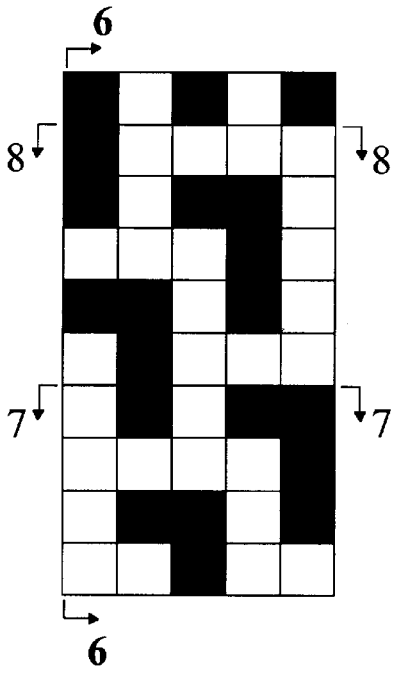
FIG. 5 is a weave pattern diagram of a second embodiment of the papermaking fabric.
Figure 6:
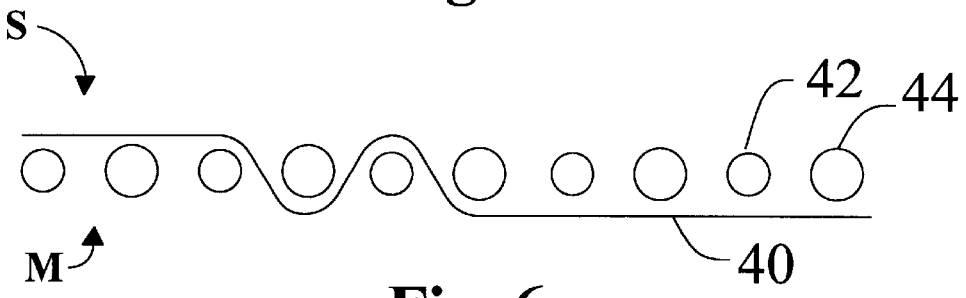
FIG. 6 is a sectional view depicting a second weave pattern for the MD filament along the line 6—6 in FIG. 5.
Figure 7:
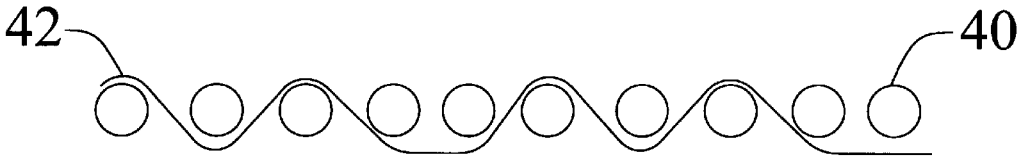
FIG. 7 is a sectional view depicting a second weave pattern for the smaller diameter CD filament along the line 7—7 in FIG. 5.
Figure 8:
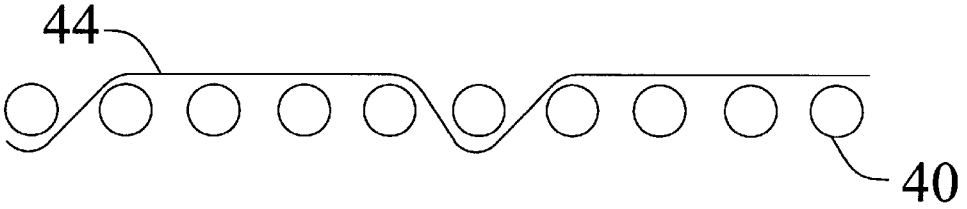
FIG. 8 is a sectional view depicting a second weave pattern for the larger diameter CD filament along the line 8—8 in FIG. 5.

As shown by the shade regions in FIG. 1*a*, sheet side S plane differences are created by alternating the smaller and larger diameter CD filaments 22, 24. Alternating the larger diameter filaments 24 and the smaller CD filaments 22 creates a (plane depth) which will increase sheet bulk without adversely effecting sheet release in forming or bleed through prevention in through air drying.

In the embodiment shown in FIGS. 5–8, MD filaments 40 weave in the repeat pattern of over three, under one, over one and under five with respect to both the smaller and larger diameter CD filaments 42, 44. Smaller diameter CD filaments 42 weave in a repeat pattern of over one, under one, over one, and under two with respect to MD filaments 40. Larger CD filaments 44, like CD filaments 24, weave in a repeat pattern of under one and over four with respect to MD filaments 40.

The diameter of the larger diameter CD monofilaments is in a range between about 0.1 to 0.8 mm and preferably about 0.4 mm. The diameter of the smaller diameter CD filaments is in a range between about 0.08 and about 0.6 mm, preferably about 0.25 mm.

The MD and CD filaments may be polyester, polyamide, vinyl, acrylic and other materials as known in the art. In a preferred embodiment of the present invention, the filaments are made of polyester which has been treated for hydrolysis resistancy. The filaments may be of different compositions.

In a preferred embodiment of the present invention, the fabric as woven achieves an air permeability of 450 to 650 CFM most preferably about 550 CFM. Other embodiments can exhibit an air permeability up to 1000 CFM. The fabric of the present invention preferably has an open area of 5% to 30%, more preferably 10%. The fabric of the present invention may be woven in an endless configuration or may be woven flat.

In summary, it can be seen that the larger diameter CD filaments will define sheet side floats of at least four filaments and the smaller diameter yarns will define floats or knuckles and floats that are within two filaments of each other. This provides the papermaker with a fabric having high sheet release floats and sheet bulking depressions without the need to choose between them.

Figure 9:
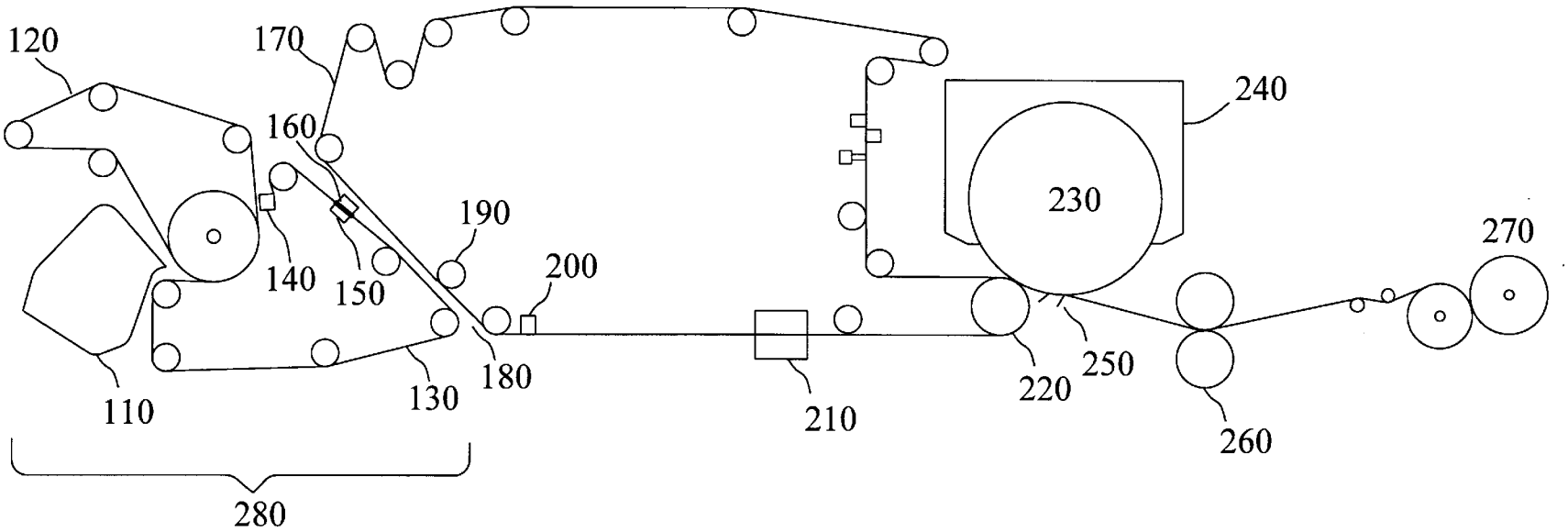
FIG. 9 is an illustration of a process for forming a paper web using a through air dryer paper machine.

As an example, one conventional forming and through air drying process is illustrated in FIG. 9. In this process, fibers are fed from a headbox (110) to a converging set of forming fabrics (120,130). In this twin wire forming arrangement water is removed from the web by centrifugal forces and by vacuum means. The wet nascent web is cleanly transferred to forming fabric (130) via uhle box (140). The web can be optionally processed to remove water by vacuum box (150) and steam shroud (160). The web is carried along forming fabric (130) until it is transferred to a through air drying fabric (170) at junction (280) by means of a vacuum pickup shoe (190). The web is further dewatered at dewatering box (200) to increase web solids. The web is then carried on the through air drying fabric (170) to a drying unit (210) where heated air is passed through both the fabric and the web to increase the solids content of the web. Generally, the web is 30 to 95% dry after exiting drying unit (210).

We claim:

1. A single layer papermaking fabric which imparts bulk to a paper product and has a sheet side and a machine side is comprised of:

a system of machine direction (MD) filaments selectively interwoven with a system of cross-machine direction (CD) filaments having alternating smaller and larger filaments, the MD filaments and the larger CD filaments define maximum float lengths on opposite sides of the fabric that differ by no more than one filament of the other system and the smaller CD filaments are woven in a repeat pattern that includes passing under at least two adjacent MD filaments and over at least one MD filament so that the length of an exposed portion of the smaller CD filaments on the sheet side of the fabric is within two MD filaments of the length of an exposed portion of the smaller CD filaments on the machine side of the fabric such that sheet side areas of paper bulking depressions are defined.

2. The papermaking fabric of claim 1 wherein the MD filaments weave in a repeat pattern of over one, under two, over two, and under five with respect to both the smaller and larger diameter CD filaments.

3. The papermaking fabric of claim 1 wherein the MD filaments weave in a repeat pattern of over three, under one, over one and under five with respect to both the smaller and larger diameter CD filaments.

4. The papermaking fabric of claim 1 wherein the larger diameter CD filaments have a diameter which is in a range between about 0.1 to 0.8 mm.

5. The papermaking fabric of claim 1 wherein the larger diameter CD filaments have a diameter of about 0.4 mm.

6. The papermaking fabric of claim 1 wherein the smaller diameter CD filaments have a diameter that is in a range between about 0.08 and about 0.6 mm.

7. The papermaking fabric of claim 1 wherein the smaller diameter CD filaments have a diameter of about 0.25 mm.

8. The papermaking fabric of claim 1 wherein the fabric achieves an air permeability which is in a range of about 450 to 650 CFM.

9. The papermaking fabric of claim 1 wherein the fabric achieves an air permeability of about 550 CFM.

10. The papermaking fabric of claim 1 wherein the fabric has an open area which is about 5% to 30%.

11. The papermaking fabric of claim 1 wherein the fabric has an open area of about 10%.

12. A process of making a paper sheet having increased bulk comprising steps of:

providing through air dryer papermaking equipment;

providing a single layer through air drying fabric in the through air dryer equipment, the through air dryer fabric having sheet and machine sides, the fabric further comprised of a system of machine direction (MD) filaments selectively interwoven with a system of cross-machine direction (CD) filaments having alternating smaller and larger filaments, the MD filaments and the larger CD filaments define maximum float lengths on opposite sides of the fabric that differ by no more than one filament of the other system and the smaller CD filaments are woven in a repeat pattern that includes passing under at least two adjacent MD filaments and over at least one MD filament so that the length of an exposed portion of the smaller CD filaments on the sheet side of the fabric is within two MD filaments of the length of an exposed portion of the smaller CD filaments on the machine side of the fabric such that sheet side areas of paper bulking depressions are defined;

providing a partially dewatered paper web to the sheet side of the through air dryer fabric; and providing means for impressing the paper web against the fabric and into the fabric depressions.

* * * * *